US006092342A

United States Patent [19]

Sharapata

[11] Patent Number: 6,092,342

[45] Date of Patent: Jul. 25, 2000

[54] POLE ANCHOR BASE PLATE

[76] Inventor: Alex Raymond Sharapata, 26 E. Scranton Ave., Lake Bluff, Ill. 60044

[21] Appl. No.: 09/053,794

[22] Filed: Apr. 2, 1998

[51] Int. Cl.[7] ..... E02D 5/47

[52] U.S. Cl. ..... 52/298; 52/704; 52/708; 52/152; 248/519

[58] Field of Search ..... 52/298, 704, 708, 52/152; 248/539, 519, 511

[56] References Cited

U.S. PATENT DOCUMENTS

| | | | |
|---|---|---|---|
| 349,240 | 9/1886 | Thomas | 52/298 |
| 602,662 | 4/1898 | Miller | 248/519 |
| 1,053,255 | 2/1913 | Ward | 248/519 |
| 3,245,181 | 4/1966 | Stephenson | 52/298 |
| 3,333,802 | 8/1967 | Goodman | 248/43 |
| 3,583,116 | 6/1971 | Lague | 52/298 |
| 4,582,287 | 4/1986 | DeLeary | 248/519 |
| 5,427,346 | 6/1995 | Urgola | 248/519 X |
| 5,568,909 | 10/1996 | Timko | 52/298 X |
| 5,634,482 | 6/1997 | Martin | 135/16 |
| 5,702,086 | 12/1997 | Hunt | 248/519 |

*Primary Examiner*—Carl D. Friedman
*Assistant Examiner*—Phi Dieu Tran A

[57] ABSTRACT

The invention relates to a new type of tent pole base plate that is multifunctional. The new base plate aids in the positioning and the support of tent poles and keeps poles on plate and in proper position. It can be anchored to any surface and will serve as an anchor for both tent poles and tent side walls. Its use will eliminate the use of protruding stakes as pole anchors and will reduce the flapping of tent side wall.

1 Claim, 2 Drawing Sheets

POLE ANCHOR BASE PLATE

CROSS REFERENCE TO RELATED APPLICATION

Field of Search 135-16

Reference Cited

U.S. Patent Document

U.S. Pat. Nos. 5,634,482, Apr. 25, 1995: Leo Martin 135-16 U.S. Pat. No. 1,053,255. Feb. 18, 1913: F. H. Ward Ser. No. 652,810. U.S. Pat. No. 602,662. Apr. 19, 1898: R. Miller Ser. No. 658,951.

BACKGROUND OF THE INVENTION

This invention relates to a new type of tent pole base plate that is multifunctional. This base plate includes an inclined segment with a cord hole through its center which tent side wall can be fastened and anchored, thus minimizing flapping and through which a tow line can be attached for towing the base plate with an accompanying pole straight into position. The inclined segment features also permit easy maneuvering of poles without upsetting the terrain. The base plate also includes a wide tube collar which will accommodate multiple sizes and shapes of tent poles for retention purposes. It has a broad base segment which supports the pole. Several holes are provided in the base segment through which fasteners can be driven to anchor base plate securely.

U.S. Pat. No. 5,634,482 to Leo Martin has a prior art device described as a base and pole stand comprising of a weighted base and insert, primarily used to stabilize free standing patio furniture. A fitted pole can be secured to the base and insert by means of a set screw.

Before the above prescribed time in the tent industry, no single device was available that could be anchored to a surface, serve as an anchor for both poles and side walls, support and restrain poles, and be used as an installation tool. Poles are currently set on wood blocks and often slide off. Protruding stakes are installed beside side poles to provide anchoring. Damage to terrain often occurs when positioning poles. Also, wind can blow side walls back and forth freely. This improved base plate eliminates each of the above described problems.

SUMMARY OF THE INVENTION

This multipurpose base plate relates to the supporting and securing of tent poles and side walls, and will also be an important tool used in the tent installation process.

The base plate's inclined segment and cord hole through its center are unique features provided for two very useful purposes. First, a cord can be fastened outside the tent side wall from the cord hole conveniently located on the inclined segment of the base plate to the top of an accompanying pole. This will contain the side wall between the side pole and the cord thus restricting its movement. Prior to this, tent side walls were fastened only at the top allowing them to flap unrestricted. Secondly, the inclined segment will allow the base plate to be used as a tool for towing an accompanying pole into proper alignment. A towline can be attached to the base plate through the cord hole on the inclined segment for this purpose. This will aid in the installation of tension—rope tents where poles must be guided into an upright position after tent rope slack has been taken up and tied off to a stake. Prior to this invention, poles had to be manually pushed across the surface and lifted into place.

The tube collar feature prevents the lateral movement of the accompanying pole and also prevents it from slipping off the plate. This is imperative when wind could push the tent side walls against the pole, and consequently the pole out of position.

The new base plate also serves as a tent pole anchor. Several holes located in its base segment allow it to be anchored flush to any surface with spikes or screws according to surface requirements. In the past, a protruding stake inserted next to the pole was used as an anchor.

The base segment of the base plate supports the load bearing pole and prevents it from sinking into the surface.

DETAILED DESCRIPTION OF THE INVENTION

Figure 3:
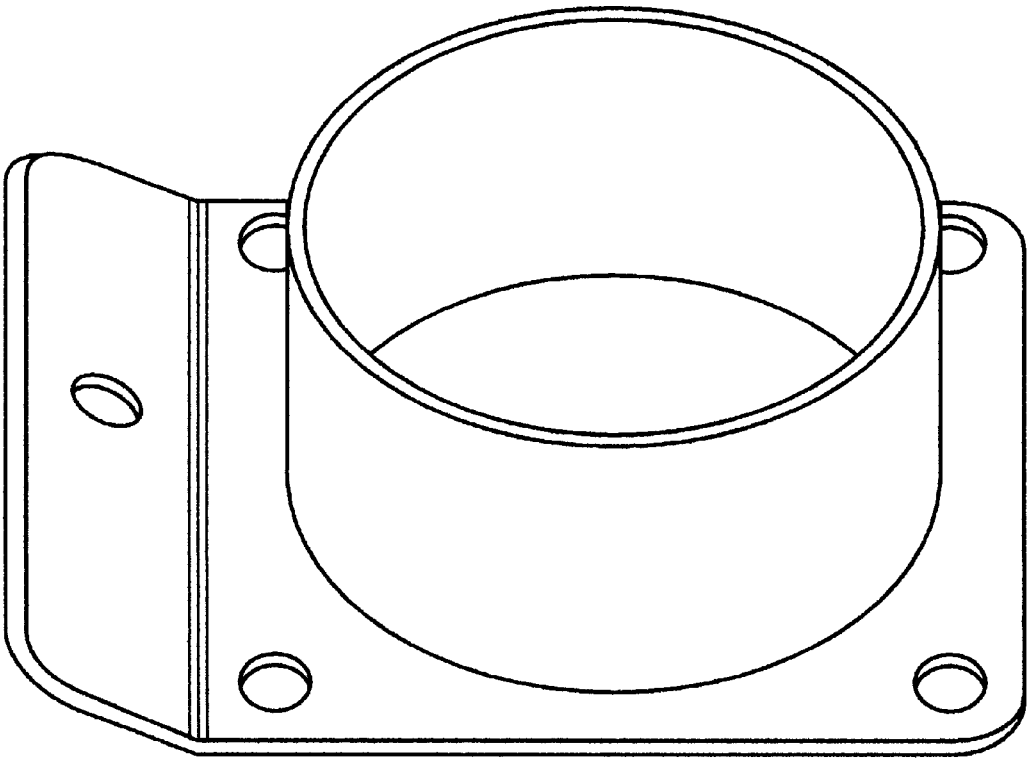
FIG. 3 is an angled view of the pole anchor base plate.

In FIG. 3, the new pole anchor base plate is shown in an angled view.

Figure 1:
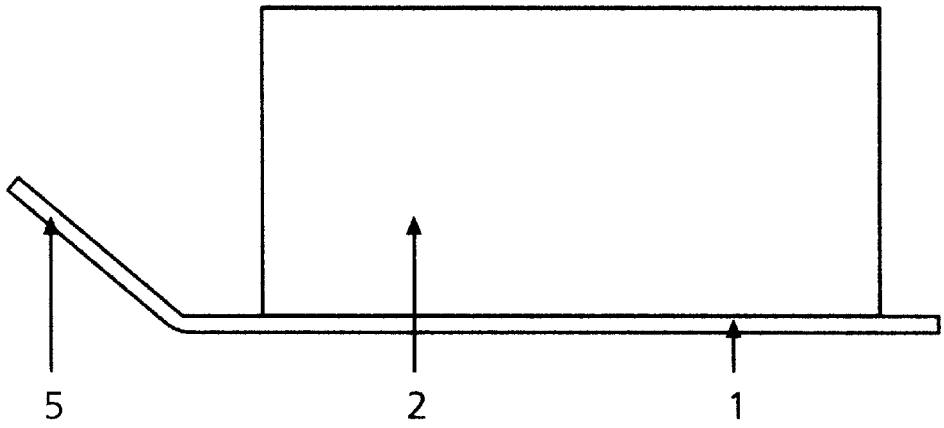
FIG. 1 is a side view of the pole anchor base plate.
Figure 2:
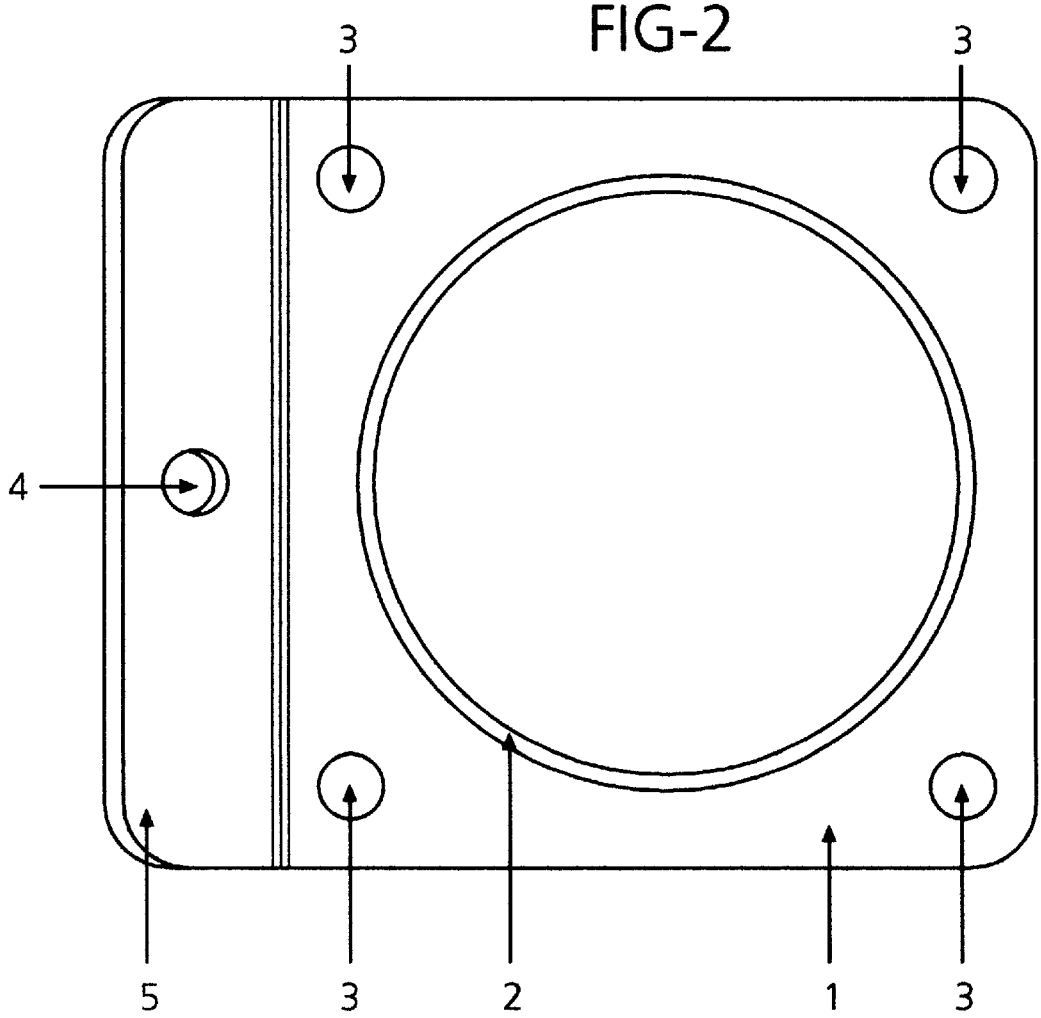
FIG. 2 is a top view of the pole anchor base plate.

In FIG. 1 and 2, the base segment 1 is for the support of a load bearing tent pole.

In FIG. 1 and 2, the inclined segment 5 aids in towing the base plate with an accompanying pole into position.

In FIG. 2, the cord hole 4 is provided for securing the towline that is used to position the base plate and pole and also for securing tent side wall.

In FIG. 2, the four anchor holes 3 provide means for anchoring base plate to a surface.

In FIG. 1 and 2, the tube collar 2 is welded or cast on the top side of the base segment so as to allow a tubular pole to fit over it and a tubular or solid pole to be inserted into it and the lateral movement of an accompanying pole.

I claim:

1. A multipurpose pole anchor base plate for the support pole of a tent comprising:

a} one base segment for the support of a load bearing pole and one inclined segment to aid in the positioning of the base plate and pole;

b} a hole exactly in the center of said inclined segment to provide a means for securing tent side wall and towline;

c} a tube collar, with its length in a vertical position, rigidly mounted on the top surface of said base segment as means of prevention of lateral movement of an accompanying pole;

d} four holes, one at each corner of said base segment, as means for anchoring said base plate.

* * * * *